US005889444A

United States Patent [19]

Johnson et al.

[11] Patent Number: 5,889,444

[45] Date of Patent: Mar. 30, 1999

[54] BROADBAND NON-DIRECTIONAL TAP COUPLER

[75] Inventors: Joseph M. Johnson; Carl G. Schuster; Bernard J. Werlau, all of Brewster; Glenn C. Werlau, Patterson, all of N.Y.

[73] Assignee: Werlatone, Incorporated, Brewster, N.Y.

[21] Appl. No.: 808,513

[22] Filed: Feb. 27, 1997

[51] Int. Cl.[6] ..... H01P 5/12

[52] U.S. Cl. ..... 333/127; 333/128

[58] Field of Search ..... 333/127, 128

[56] References Cited

U.S. PATENT DOCUMENTS

| | | | |
|---|---|---|---|
| 2,643,296 | 6/1953 | Hansen | 333/127 |
| 4,310,814 | 1/1982 | Bowman | 333/128 X |
| 5,563,558 | 10/1996 | Mohwinkel et al. | 333/127 |
| 5,576,671 | 11/1996 | Agar, Jr. et al. | 333/128 |

OTHER PUBLICATIONS

Waki, *Wideband, Unequal Split Ratio Wilkinson Power Divider,* Microwave Journal, Sep. 1985, pp. 205–209, Sep. 1985.

*Primary Examiner*—Paul Gensler

*Attorney, Agent, or Firm*—St. Onge Steward Johnston and Reens LLC

[57] ABSTRACT

A non-directional tap coupler for use in high power operation over a wide bandwidth is provided. The tap coupler has an input line electrically connectable to a transmission line of a distributed transmission line system, a tap line coupled to the input line and an output line coupled to the input line. The input line, tap line and output line include sections having different characteristic impedances, with all of the different characteristic impedances falling within a practical characteristic impedance range. An electrical junction where the input line electrically joins the tap line and the output line is provided with a predetermined impedance value to ensure that the sections of the tap line and the output line all fall within the practical characteristic impedance range.

6 Claims, 5 Drawing Sheets

BROADBAND NON-DIRECTIONAL TAP COUPLER

FIELD OF THE INVENTION

The invention relates to a broadband non-directional tap coupler, and more specifically, to an uneven power divider for use in high power operation over a wide bandwidth which provides a tap line within a practical impedance range.

BACKGROUND OF THE INVENTION

As the need for distributed information becomes greater and greater, there is likewise a need for distributed, high power transmission line systems to handle this increasing communication traffic. A typical distributed transmission line system comprises a main transmission line and one or more tap lines coupled to the main transmission line for receiving signals from the main transmission line. A familiar distributed transmission line system is the coaxial cable system which brings cable TV to television sets. More sophisticated distribution systems are bi-directional, transmitting and receiving signals of many services located at various frequencies throughout the radio frequency spectrum. These signals include FM radio, PCS and cellular phone services. A typical distributed communications application employs radiating coaxial cables in underground subway systems. To add branch lines to the main coaxial cable, non-directional taps or couplers are required. The operational frequency range of the taps must span the range of these various services, which are located between 88 and 2000 MHz.

Some of the difficulties associated with providing non-directional tap couplers over a broad frequency bandwidth are as follows. First, it is difficult to provide a non-directional tap coupler which can maintain a relatively constant coupling ratio (power transmitted by tap line/power transmitted by main transmission line) over the broad frequency spectrum. Second, it is difficult to provide a non-directional tap coupler in which the voltage standing wave ratio (VSWR) is kept close to the minimum value of 1. VSWR is the ratio of the maximum voltage to the minimum voltage on a line. As known, when a load ($R_L$) matches the characteristic impedance ($Z_0$) of a line, there is no reflected wave so that $V_{max}$ equals $V_{min}$ and the VSWR is 1. It is important to minimize the VSWR to keep losses low.

Finally, even if the difficulties associated with providing non-directional tap couplers over a broad frequency bandwidth discussed above are overcome, it must be done in a manner which provides a tap line within a "practical characteristic impedance range". As known, the greater the characteristic impedance of a line, the narrower the width of the line, and vice versa. Thus, if the characteristic impedance of the tap line is a high value, this will require an ultra thin (describable in terms of hair-width or thinner) tap line; thereby making the manufacture of the non-directional tap coupler very difficult and expensive. Furthermore, an ultra thin tap line is limited in terms of its power handling capability. Therefore, the characteristic impedance of the tap line must fall within the "practical characteristic impedance range," which is defined herein as the range of characteristic impedances which provide tap lines with sufficient power handling capability to transmit signals throughout the radio frequency spectrum and which do not require an ultra thin tap line that is practically unfeasible to manufacture due to the difficulty and expense involved.

What is desired, therefore, is a non-directional tap coupler for use in high power operation over a wide bandwidth which minimizes losses while providing a tap line within a practical characteristic impedance range.

SUMMARY OF THE INVENTION

Accordingly, it is an object of the present invention to provide a non-isolated power divider which is able to divide power in uneven ratios.

It is a further object of the present invention to provide a tap coupler in which the coupling ratio can be kept relatively constant over a very wide frequency range.

It is yet another object of the present invention to provide a non-directional tap coupler in which the coupling ratio can be maintained at high power levels.

A still further object of the present invention is to provide a non-directional tap coupler in which the voltage standing wave ratio (VSWR) at the input port of the tap can be kept very small over the same very large frequency range in which the coupling ratio remains constant.

It is yet another object of the present invention to provide a non-directional tap coupler which is virtually free of IM distortion products at high power levels over the same very large frequency range in which the coupling remains constant.

Still another object of the present invention is to provide a non-directional tap coupler in which a fraction of the main line power is coupled to the tap or branch line independent of the direction of power on the main line.

Yet another object of the present invention is to provide a non-directional tap coupler in which the characteristic impedance of all transforming sections falls within practical dimensional limits consistent with high power operation.

These and other objects of the invention are achieved by a non-directional tap coupler for use in high power operation over a wide bandwidth. The tap coupler has an input line electrically connectable to a transmission line of a distributed transmission line system, a tap line coupled to the input line and an output line coupled to the input line. The input line, tap line and output line include sections having different characteristic impedances, with all of the different characteristic impedances falling within a practical characteristic impedance range. An electrical junction where the input line electrically joins the tap line and the output line is provided with a predetermined impedance value to ensure that the sections of the tap line and the output line all fall within the practical characteristic impedance range.

The invention and its particular features and advantages will become more apparent from the following detailed description considered with reference to the accompanying drawings.

DETAILED DESCRIPTION OF THE INVENTION

Figure 1:
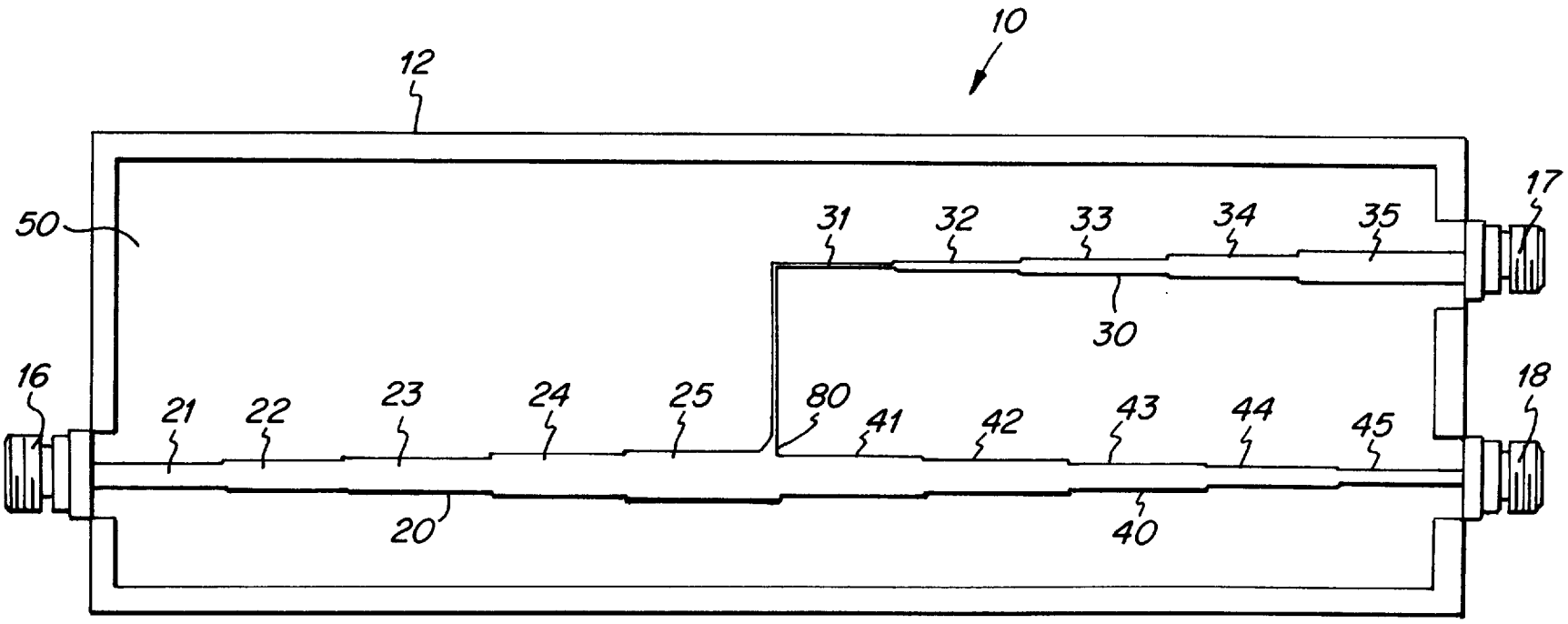
FIG. 1 is a stop view of one embodiment of a broadband non-directional tap coupler of the present invention.

FIG. 1 is a top view of one embodiment of a broadband non-directional tap coupler 10 of the present invention. The broadband non-directional tap coupler 10 includes a casing 12 and first, second and third coaxial connectors 16, 17 and 18. The broadband non-directional tap coupler 10 also includes an input line 20 coupled to two output lines 30 and 40 at a junction 80, where the lines 20, 30 and 40 are preferably formed from copper microstrip conductors, and a conductive ground plane (not shown) underneath the input line 20 and the output lines 30 and 40. The input and output lines 20, 30 and 40 are electrically separated from the conductive ground plane by an insulating material 50, such as Teflon®.

In the embodiment shown, the input line 20 has five sections 21, 22, 23, 24 and 25 of differing width, where each section is of substantially equal electrical length. As discussed in the Background of the Invention section, the differing widths of the five sections 21, 22, 23, 24 and 25 means that there is a different characteristic impedance associated with each section. The first output line 30 has five sections 31, 32, 33, 34 and 35 of differing width (hence, differing characteristic impedances) with substantially equal electrical length, and the second output line 40 has five sections 41, 42, 43, 44 and 45 of differing width (hence, different characteristic impedances) with substantially equal electrical length. As will be described hereinafter, the number of sections for each line 20, 30 and 40 is significant in determining the frequency spectrum or the bandwidth of operation for the broadband non-directional tap coupler 10. Also, the number of output lines coupled to the input line 20 is determined by the desired use for the broadband non-directional tap coupler of the present invention. Where more than two output lines 30, 40 shown in FIG. 1 is desired, the broadband non-directional tap coupler 10 can be modified in a manner apparent to those skilled in the art to accommodate the additional output lines.

Figure 3:
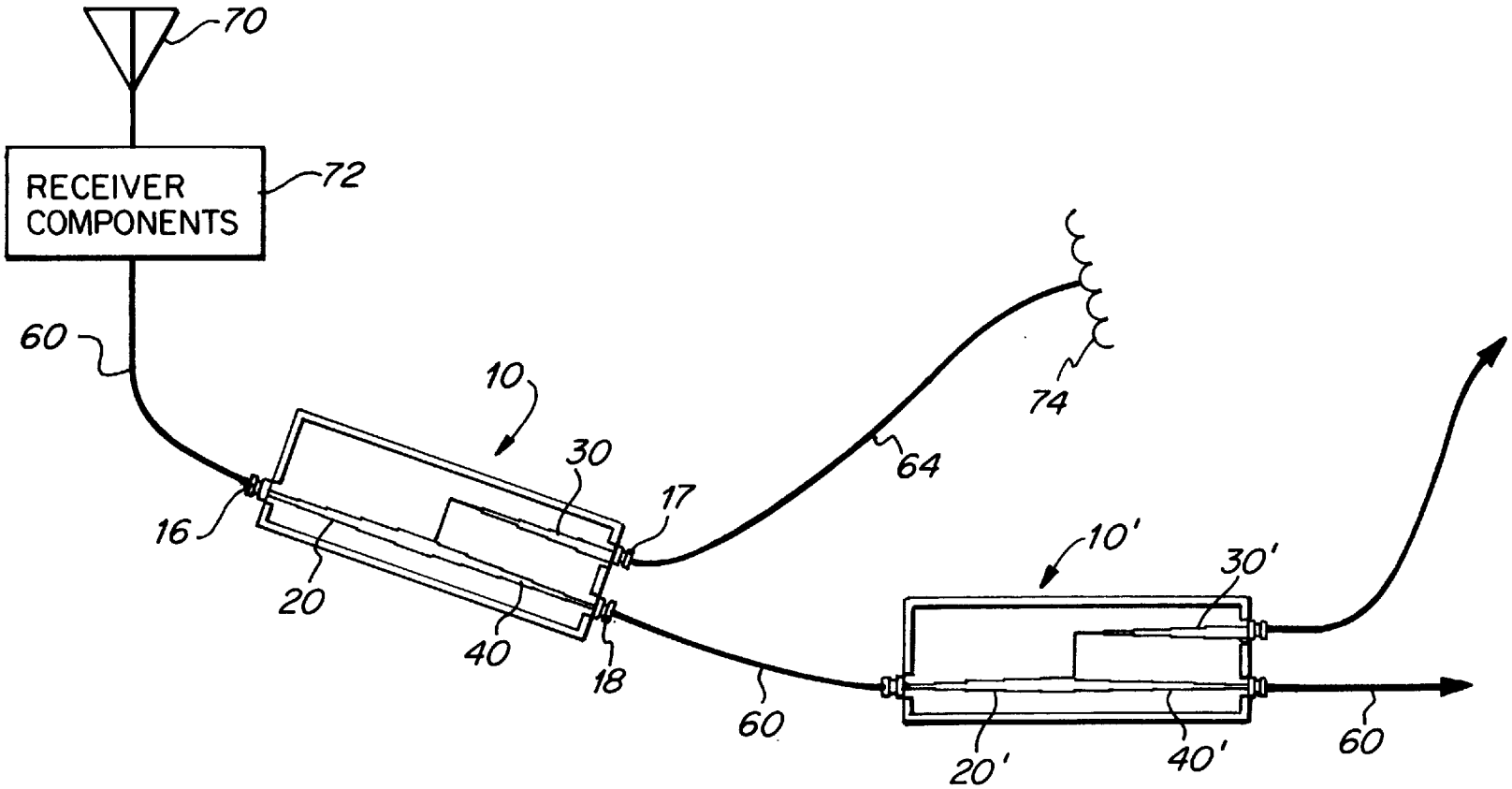
FIG. 3 shows a distributed transmission line system incorporating the non-directional tap coupler of FIG. 1.

A main transmission line 60 of a distributed transmission line system is coupled to the input line 20 of the broadband non-directional tap coupler 10 through the first coaxial connector 16 (the mating connector on the main transmission line 60 is not shown), as illustrated in FIG. 3. For the exemplary distributed transmission line system of FIG. 3, the communication signals transmitted thereon are first received by an antenna 70 and processed through appropriate conventional receiver components 72. The use of coaxial connectors 16, 17 and 18 in the broadband non-directional tap coupler 10 shown in FIGS. 1 and 3 contemplates the use of coaxial or radiating coaxial cables in the distributed transmission line system.

The input and output lines 20, 30 and 40 are in electrical contact with the inner conductors of the coaxial cables coupled to the broadband non-directional tap coupler 10, and the conductive ground plane is in electrical contact with the outer conductors of the coaxial cables.

In the embodiment of the broadband non-directional tap coupler 10 shown in FIG. 3, the first output line 30 serves as a tap line while the second output line 40 serves as a continuation of the main transmission line 60. Note that the output of the second output line 40 is coupled to the input line 20' of another broadband non-directional tap coupler 10'. The output of the tap line 30 is coupled through a coaxial cable 64 to a load or termination 74. Although not shown in FIG. 3, there may be conventional RF amplifiers and/or repeaters positioned along the transmission line system at regular intervals to reinforce the communication signals traveling thereon.

Typical coaxial cable lines have characteristic impedances in the range of 50 to 100 ohms. For purposes of illustration, it can be assumed that the coaxial cables 60 and 64 utilized in the distributed transmission line system of FIG. 3 have a characteristic impedance ($Z_0$) of 50 ohms. For the embodiment of the invention shown herein, it is desired for exemplary purposes that the tap line 30 of the broadband non-directional tap coupler 10 receive ¼ of the power appearing on the input line 20. This means that the second output line 40 is to receive ¾ of the power of the input line 20. It can be further assumed for this exemplary embodiment that the desired frequency bandwidth encompasses 80 MHz to 2000 MHz (or 2 GHz), and that the input and output lines 20, 30 and 40 are microstrip conductors on a substrate of 1/16-inch or less in thickness.

It has been found from experimentation that for microstrip conductors on a substrate of 1/16-inch or less in thickness, the characteristic impedances well in excess of 100 ohms fell out of the "practical characteristic impedance range". As defined in the Background of the Invention, "practical characteristic impedance range" means the range of characteristic impedances which provide tap lines with sufficient power handling capability to transmit signals throughout the radio frequency spectrum and which do not require an ultra thin tap line that is practically unfeasible to manufacture due to the difficulty and expense involved. Therefore, for the illustrated embodiment which utilizes one-quarter wavelength transformers and microstrip conductors on a substrate of 1/16-inch or less in thickness, the characteristic impedances of the input and output lines 20, 30 and 40 should be designed to have values that are not significantly in excess of 100 ohms. Preferably, the input and output lines 20, 30 and 40 will have impedances less than 100 ohms.

Figure 4:
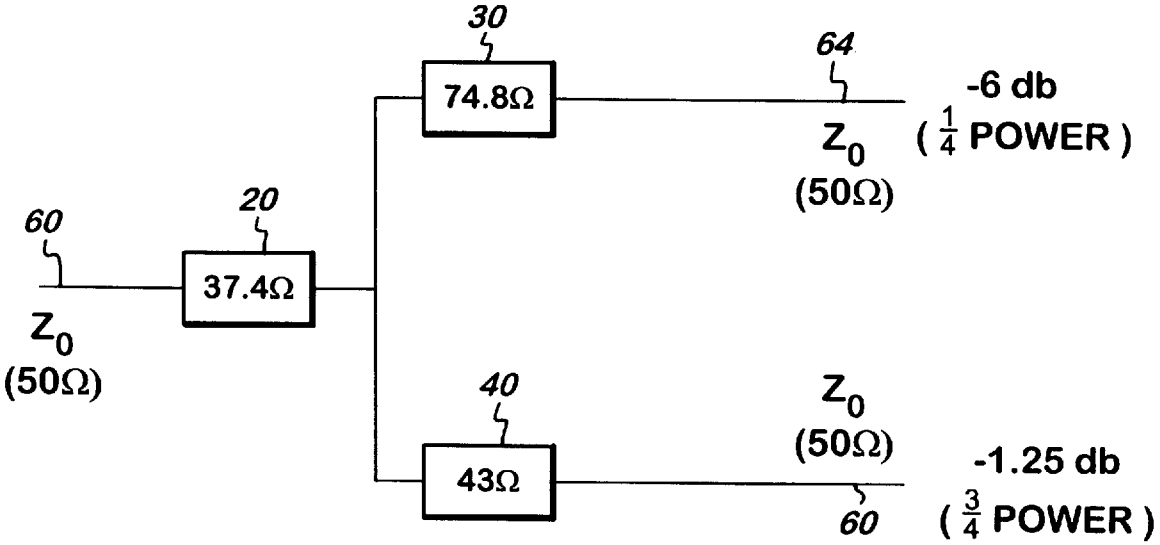
FIG. 4 shows a non-broadband or narrow band power divider having a tap line receiving ¼ of power appearing at the input.

It has also been determined from experimentation that the power divider utilizing one-quarter wavelength transformers having characteristic impedances for the coaxial cables 60 and 64 and the input and output lines 20, 30 and 40 as indicated in FIG. 4 results in the tap line 30 having ¼ of the power of the input line 20. Although the power divider of FIG. 4 provides the desired practical characteristic impedance range, it does not provide the desired broad frequency bandwidth of 80 MHz to 2 GHz.

Figure 2:
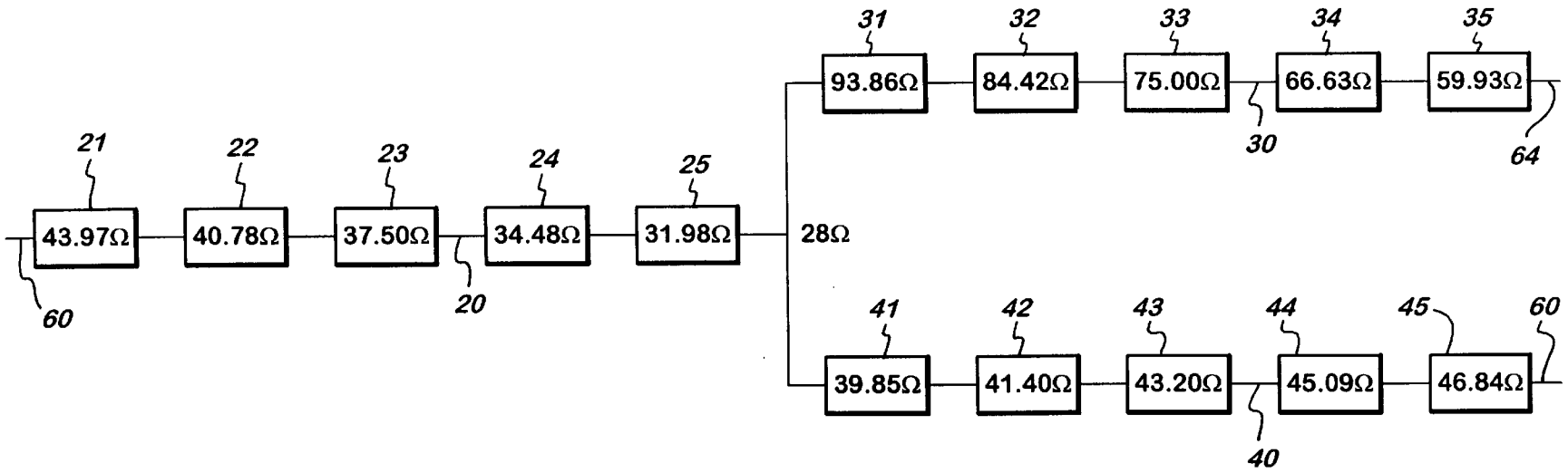
FIG. 2 shows the characteristic impedances of input and output lines of the non-directional tap coupler of FIG. 1.

In order for the power divider of FIG. 4 to provide the desired broad frequency bandwidth of 80 MHz to 2 GHz as well as the desired practical characteristic impedance range, the power divider must be transformed to a successive step transformer structure as shown in FIGS. 1 and 2. Transforming the power divider of FIG. 4 into the successively stepped power divider of FIGS. 1 and 2 is a math-intensive operation. However, before undertaking the necessary mathematics, it is essential to determine a parallel equivalent impedance at the input junction 80 of the output lines 30 and 40 which will ensure that the sections 31–35 and 41–45 of the output lines 30 and 40, respectively, all have characteristic impedances within the practical characteristic impedance range.

A suitable impedance value for the input junction 80 is determined and then used to properly transform the tap coupler of FIG. 4 into the successively stepped tap coupler of FIG. 2. First, a suitable impedance value for the input junction 80 is determined from the characteristic impedances of lines coupled to the connectors 16, 17 and 18, in this case coaxial cables 60 and 64, as well as the impedances of the input and output lines 20, 30 and 40 (shown in FIG. 4).

From these stated impedance values, a number of impedance values which may be suitable as the impedance value for the input junction 80 are determined.

For the example provided herein, setting the input junction 80 at 28 ohms permits the desired transformation while keeping the characteristic impedances of the output sections 31–35 and 41–45 within the practical characteristic impedance range (in this example, preferably under 100 ohms). Twenty-eight (28) ohms was one of the values selected for the impedance of the input junction 80 because impedances of the output sections 31–35 and 41–45 then fall within the practical characteristic impedance range. Lowering the junction 80 impedance to 28 ohms requires an increase in the width of the input line 20 leading to the input junction 80 to properly transform junction 80 impedance.

One of the impedance values selected for the input junction 80 is then used to determine the number of steps or sections needed in the output lines 30 and 40 as well as the operational bandwidth of the tap coupler 10, as discussed in the following.

The mathematics necessary to determine the number of steps needed in the output lines 30 and 40, as well as the mathematics necessary to determine the operational bandwidth of the power divider 10, involve a Tchebycheff polynomial, which is then used to obtain an estimate of the maximum voltage standing wave ratio (VSWR) and the bandwidth. From the solved Tchebycheff polynomial, the estimated maximum VSWR, and the bandwidth, the impedance for each step of the output lines 30 and 40 can be calculated. The mathematics necessary for these calculations are known and can be found, for example, in an article authored by S. B. Cohn entitled "Optimum Design of Stepped Transmission-Line Transformers," IRE Trans. on Microwave Theory and Techniques, vol. MTT-3, pp. 16–21, April 1955, which is incorporated herein by reference.

The result of the math-intensive operation is the power divider 10 shown in FIGS. 1 and 2. As illustrated in FIG. 2, none of the characteristic impedances along the tap line 30 exceeds 100 ohms. Thus, the non-directional tap coupler 10 of FIG. 2 meets all of the operational parameters set forth above.

Figure 6:
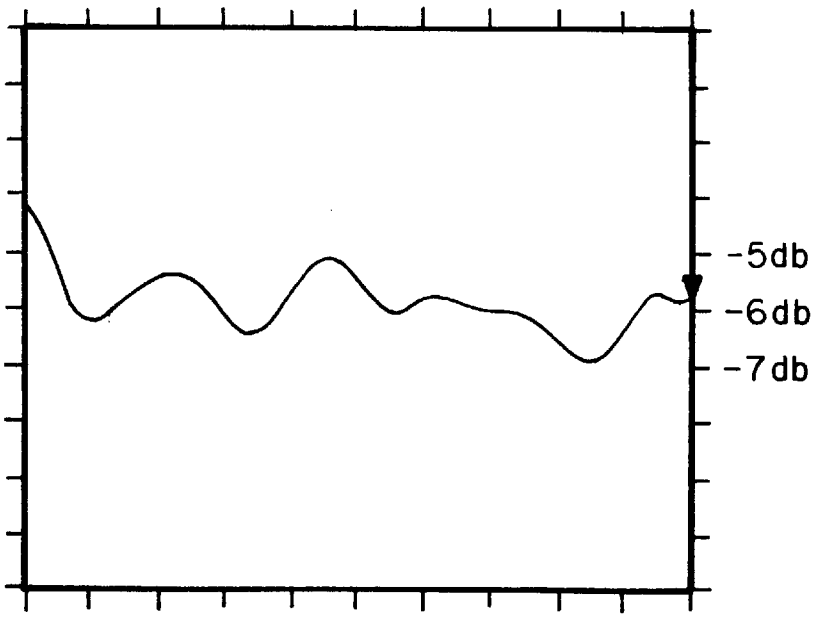
FIG. 6 shows the coupling ratio for the non-directional tap coupler of FIG. 1 over the operational frequency bandwidth of 77 to 2200 MHz.
Figure 5:
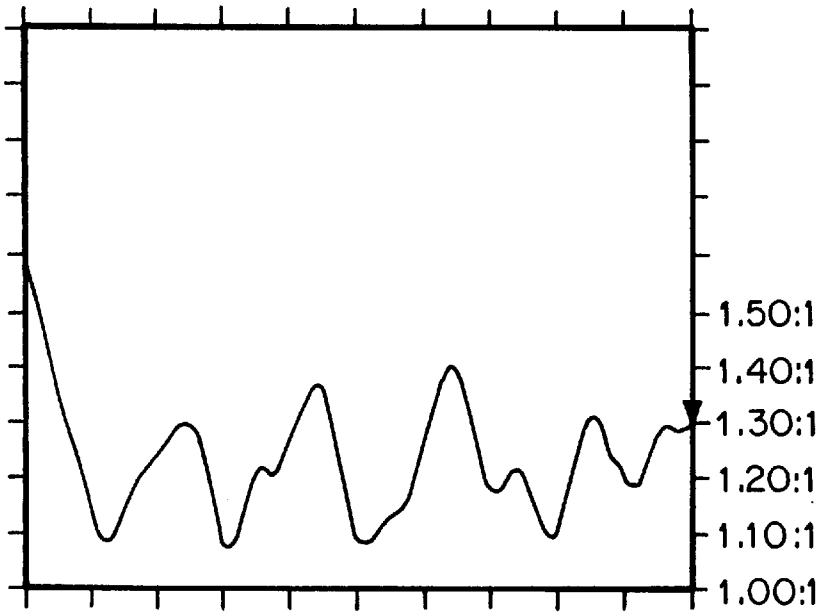
FIG. 5 shows the voltage standing wave ratio for the non-directional tap coupler of FIG. 1 over the operational frequency bandwidth of 77 to 2200 MHz.

FIGS. 5 and 6 illustrate that for the non-directional tap coupler 10 in FIG. 1 over the operational frequency bandwidth of 77 MHz to 2.2 GHz, the input VSWR is kept close to a minimum (the VSWR is substantially between the values of 1 and 1.4) while the coupling ratio (power transmitted by tap line 30/power transmitted by main transmission line 60) is maintained substantially constant (the variation is substantially within +/−1 decibel as shown in FIG. 6). Unlike the broadband non-directional tap coupler 10 of the present invention, prior art non-directional tap couplers have difficulties providing relatively constant coupling ratio over a broad frequency bandwidth while maintaining the VSWR close to a minimum as discussed in the Background of the Invention.

It should be apparent to those skilled in the art that if the operational parameters for the non-directional tap coupler 10 of FIG. 1 change from that provided herein, the design of the non-directional tap coupler can be modified accordingly to accommodate the differing operational parameters. For example, if it is desired to design a non-directional tap coupler in which the tap lines transmits ⅙ of the power applied to the input to the device, then the impedance at the input of the output lines 30 and 40 can be lowered to an appropriate value to ensure that the characteristic impedances appearing along the tap line 30 stay within the practical characteristic impedance range. It will also be evident that the characteristic impedance of all transforming steps of the non-directional tap change when a new impedance value is assigned to the input junction 80 of the output lines.

Furthermore, while FIG. 1 shows the non-directional tap coupler 10 utilizing microstrip conductors, it should also be apparent to those skilled in the art that the non-directional tap coupler of the present invention can also utilize a stripline design.

Although the invention has been described with reference to a particular arrangement of parts, features and the like, these are not intended to exhaust all possible arrangements or features, and indeed, many other modifications and variations will be ascertainable to those skilled in the art.

What is claimed is:

1. A method of designing a tap coupler such that a tap line of the tap coupler has a characteristic impedance of less than about 100 Ω, the method comprising:

(a) determining a desired power ratio between a tap line and an output line of a tap coupler;

(b) holding the desired power ratio between the tap line and the output line constant, such that an impedance ratio between the tap line and the output line is also constant;

(c) lowering an impedance of a junction between the tap line, the output line and an input line to an arbitrary value;

(d) calculating a resulting impedance of the tap line based upon the constant impedance ratio between the tap line and the output line, and the junction impedance; and (e) repeating c and d until the resulting impedance of the tap line falls below about 100 Ω.

2. The method of claim 1 further comprising:

(f) determining a desired frequency bandwidth of the tap coupler;

(g) configuring the input line to have step transformation sections for transforming the characteristic impedance of an input port to the junction impedance;

(h) configuring the tap line to have step transformation sections for transforming the tap line impedance to the characteristic impedance of a tap port; and (i) configuring the output line to have step transformation sections for transforming the output line impedance to the characteristic impedance of an output port.

3. A tap coupler produced in accordance with the method of claim 2.

4. A tap coupler produced in accordance with the method of claim 2 for operating within a frequency range of between about 80 MHz and about 2 GHz.

5. A tap coupler produced in accordance with the method of claim 1.

6. A tap coupler produced in accordance with the method of claim 1 for operating within a frequency range of between about 80 MHz and about 2 GHz.

* * * * *

UNITED STATES PATENT AND TRADEMARK OFFICE

CERTIFICATE OF CORRECTION

PATENT NO. :5,889,444

DATED :March 30, 1999

INVENTOR(S) :Joseph M. Johnson, et al.

It is certified that error appears in the above-identified patent and that said Letters Patent is hereby corrected as shown below:

At Column 2, line 52 "stop" should be replaced with --top--.

Signed and Sealed this

Seventh Day of September, 1999

*Attest:*

Q. TODD DICKINSON

*Attesting Officer*

*Acting Commissioner of Patents and Trademarks*